US007878132B2

(12) United States Patent
Asaba et al.

(10) Patent No.: US 7,878,132 B2
(45) Date of Patent: Feb. 1, 2011

(54) SEWING MACHINE

(75) Inventors: Yutaka Asaba, Tokyo (JP); Yasunori Ishii, Tokyo (JP); Sen Mizuhara, Tokyo (JP)

(73) Assignee: Juki Corporation, Chofu-shi, Tokyo (JP)

( * ) Notice: Subject to any disclaimer, the term of this patent is extended or adjusted under 35 U.S.C. 154(b) by 881 days.

(21) Appl. No.: 11/822,210

(22) Filed: Jul. 3, 2007

(65) Prior Publication Data

US 2008/0006191 A1 Jan. 10, 2008

(30) Foreign Application Priority Data

Jul. 5, 2006 (JP) ..... P.2006-185744

(51) Int. Cl.
*D05B 3/00* (2006.01)
*D05B 3/06* (2006.01)

(52) U.S. Cl. ..... 112/110; 112/65; 112/70

(58) Field of Classification Search ..... 112/65–77, 112/104, 110–115
See application file for complete search history.

(56) References Cited

U.S. PATENT DOCUMENTS 4,091,752 A * 5/1978 Odermann ..... 112/75
4,242,976 A * 1/1981 Beckerman et al. .... 112/475.25
4,594,953 A * 6/1986 Ando et al. ..... 112/112
5,261,339 A * 11/1993 Rachor ..... 112/108

FOREIGN PATENT DOCUMENTS

JP 406047178 A * 2/1994
JP 3151923 1/2001
JP 02008012052 A * 1/2008

* cited by examiner

*Primary Examiner*—Ismael Izaguirre
(74) *Attorney, Agent, or Firm*—Drinker Biddle & Reath LLP

(57) ABSTRACT

The sewing machine includes a presser body, a presser frame, a button holding device including a fixed portion and a sliding portion, a position detecting device including a sliding base attached to the presser frame and a sliding member coupled to the presser body and slidable with respect to the sliding base, a button diameter detecting switch, and a control device. The control device obtains, from the position detecting device, a shift amount of the presser body from a sewing start position when the button diameter detecting switch detects that a sewing operation is carried by a length that corresponds to a diameter of a button, and controls a drive of a sewing needle and the feeding of the workpiece such that a buttonhole stitch corresponding to the diameter of the button is formed.

4 Claims, 10 Drawing Sheets

SEWING MACHINE

The present invention claims priority from Japanese Patent Application No. 2006-185744 filed on Jul. 5, 2006, the entire content of which is incorporated herein by reference.

BACKGROUND OF INVENTION

1. Field of the Invention

The present invention relates to a sewing machine operable to form a buttonhole stitch.

2. Background Art

When forming a buttonhole stitch using a sewing machine, it is necessary to change a stitching length in accordance with a size of a button. Thus, a buttonhole stitch device operable to change the stitching length in accordance with the size of a button is employed in the sewing machine (see, e.g., Japanese Patent No. 3151923).

As shown in FIG. 9, a buttonhole stitch device 100 includes a presser member 101 attached to a lower end of a presser bar of a sewing machine. A presser frame 102 is disposed on the presser member 101 so as be slidable along a cloth feeding direction. A hollow stopper 102*a* is fixed to an upper surface of an end portion of the presser frame 102 on a side of a direction A, and a spiral spring 103 is disposed inside the stopper 102*a*. As shown in FIG. 9, the presser member 101 and stopper 102*a* are constantly biased toward each other by an elastic force of the spiral spring 103 such that they are in contact with each other at a buttonhole stitch start position.

On the other hand, a button holding device 104 is provided on the other end portion of the presser frame 102 on a side of a direction B, and the button holding device 104 is operable to hold a button B. The button holding device 104 includes a holding portion 104*a* which is slidable along the cloth feeding direction in accordance with a size of a button to be held.

A potentiometer 105 extending on an outer side of the presser frame 102 along the cloth feeding direction is attached to the presser member 101, and a detecting portion 106 which contacts the potentiometer 105 is attached to the holding portion 104*a*. The potentiometer 105 includes a variable resistor, and as shown in FIG. 10, when the presser frame 102 moves so that a contacting position of the detecting portion 105 and the potentiometer 105 is varied, a resistance value of the variable resistor varies. According to a value of a voltage to be applied to the thus varying resistance, an amount of a displacement of the presser frame 102 (i.e., the stitching length) can be detected.

At the time when the buttonhole stitch is started, an initial value of a voltage applied to the potentiometer 105 is stored in a memory of a control device. The control device starts to drive a sewing machine motor and a needle oscillation motor so as to form a bar tack 110*a* as shown in FIG. 11. Then, the control device changes a needle oscillation amount and drives a cloth feeding motor so as to stitch a left side portion 110*b* of a buttonhole. During a sewing operation, the control device checks whether a resistance value of the potentiometer 105 is 0 or not. When the control device judges that the resistance value became 0, the control device drives the sewing machine motor and the needle oscillation motor so as to form a bar tack 110*c*. Then, the control device again changes the needle oscillation amount and drives the cloth feeding motor so as to stitch right side portion 110*d* of the buttonhole. In the meantime, the control device again checks whether the resistance value of the potentiometer 105 is 0 or not, and when the control device judges that the resistance value became 0, the control device ends the sewing operation.

However, in such a buttonhole stitch device 100, because the potentiometer 105 mounted on the presser member 101 is large and long relative to the pressing member 101, the potentiometer 105 is likely to become rickety and tilted. Thus, a detection error is easy to occur when detecting the position of the presser frame 102. Moreover, because the presser frame 102 slidingly moves, an arm member coupling the detecting portion 106 and the holding portion 104*a* needs to be relatively long. Thus, the arm member is likely to become rickety and flexed, so that an error in a timing, at which the position where the resistance value becomes 0 is detected, is easy to occur. Accordingly, it has been difficult to enhance quality of the buttonhole stitch.

SUMMARY OF INVENTION

It is an object of the invention to provide a sewing machine in which a detection error of a stitching length and a detection error of a timing of switching a stitch is reduced, thereby enhancing quality of a buttonhole stitch.

According to one or more aspects of the invention, a sewing machine comprises:

a presser body supported on a lower end of a presser bar;

a presser frame which is slidable with respect to the presser body, and is operable to press a workpiece and to move in accordance with a feeding of the workpiece during a sewing operation;

a button holding device including a fixed portion, and a sliding portion facing the fixed portion and movable along a cloth feeding direction with respect to the presser frame, and wherein the button holding device is operable to hold a button between the fixed portion and the sliding portion;

a position detecting device including a sliding base attached to the presser frame so as to extend along the cloth feeding direction, and a sliding member attached to the presser body and slidable with respect to the sliding base, wherein the position detecting device is operable to detect a shift amount (a moved position) of the presser frame from a sewing start position in accordance with a contact position of the sliding member and the sliding base in the cloth feeding direction;

a button diameter detecting switch including a detecting portion attached to the presser frame and movable in the cloth feeding direction together with the presser frame, and an abutting portion which contacts with the detecting portion when the detecting portion is moved by a certain distance in accordance with a movement of the presser frame, wherein the button diameter detecting switch is operable to detect that the sewing operation is carried out by a length that corresponds to a diameter of the button held by the button holding device; and a control device which is operable to obtain, from the position detecting device, the shift amount of the presser body from the sewing start position when the button diameter detecting switch detects that the sewing operation is carried by the length that corresponds to the diameter of the button, and is operable to control a drive of a sewing needle and the feeding of the workpiece such that a buttonhole stitch corresponding to the diameter of the button is formed.

The presser body may be detachable from the needle bar.

The fixed portion may be fixed to the presser frame, and the abutting portion may be attached to the presser body.

The fixed portion may be fixed to the presser body, and the abutting portion may be attached to the sliding portion.

The sliding body may be disposed on one longitudinal side of the presser frame, and the detecting portion may be disposed on the other longitudinal side of the presser frame.

Other aspects and advantages of the invention will be apparent from the following description and the appended claims.

DETAILED DESCRIPTION

Hereinafter, exemplary embodiments of the invention will be explained with reference to the drawings, the following exemplary embodiments do not limit the scope of the invention. In the exemplary embodiments, description will be given of a sewing machine operable to perform a buttonhole stitch.

<Structure of Sewing Machine>

Figure 1:
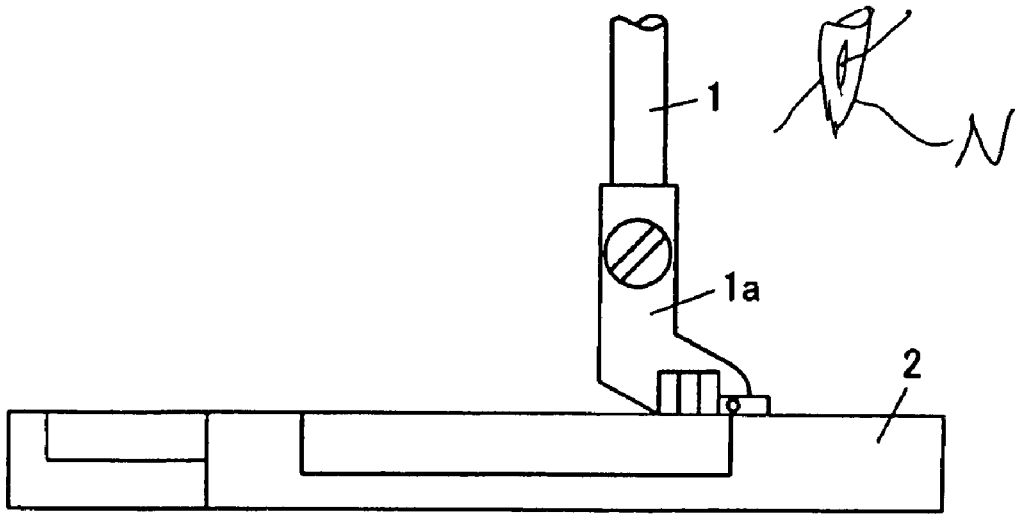
FIG. 1 is a schematic side view of a buttonhole stitch device mounted on a presser bar.

As shown in FIG. 1, a presser bar 1 is mounted on a head portion (not shown) of the sewing machine in a vertically movable manner and a downward elastic force is being applied to the presser bar 1.

The presser bar 1 includes, in the lower end thereof, a presser holder 1*a* which is made of synthetic resin and has a forked lower end portion. On the presser holder 1*a*, there is mounted a buttonhole stitch device 2 which is used to hold a piece of cloth used as a workpiece.

The buttonhole stitch device 2 is disposed such that its lower surface faces the upper surface of a throat plate on which the cloth is placed.

Figure 2:
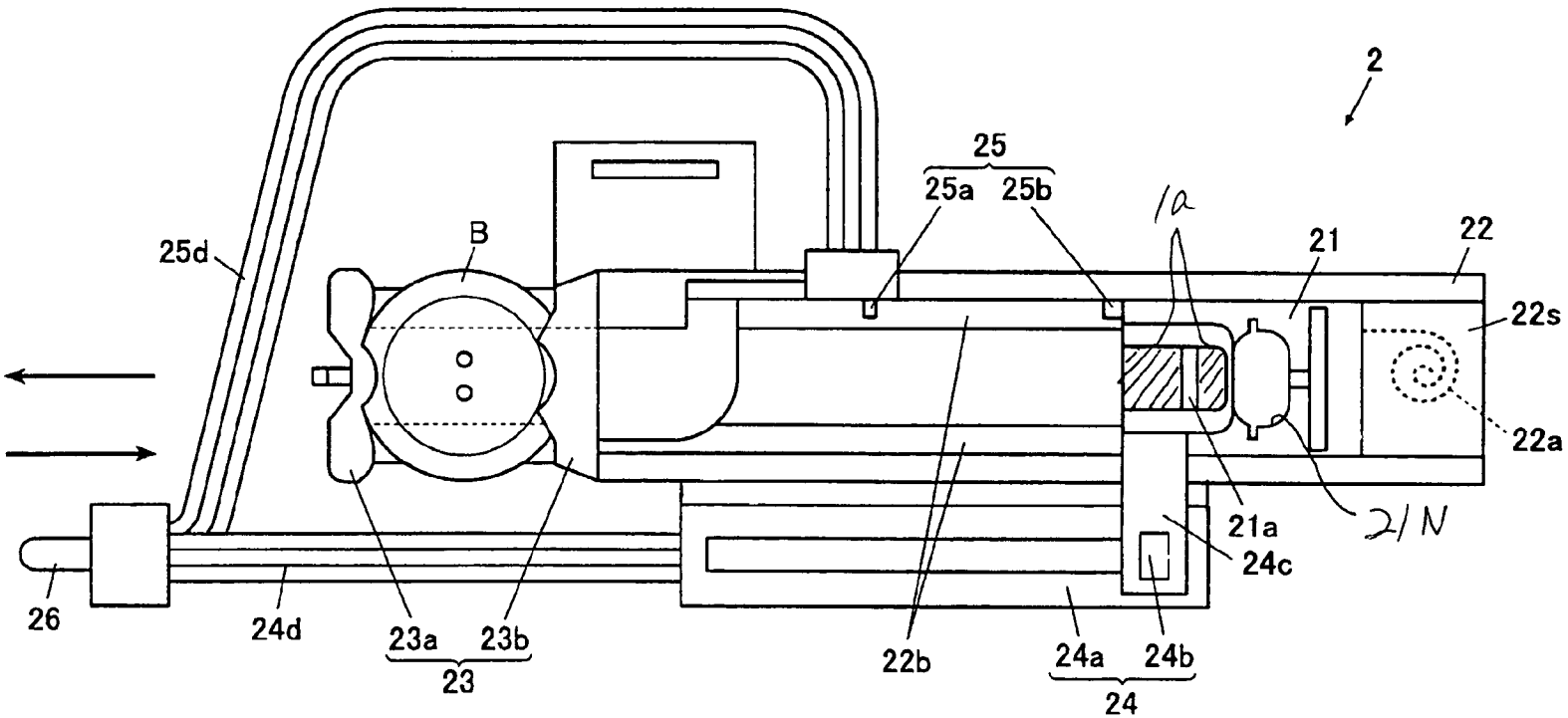
FIG. 2 is a schematic plan view of a buttonhole stitch device.

As shown in FIG. 2, the buttonhole stitch device 2 includes a presser body 21 detachably mounted on the presser holder 1*a*, a presser frame 22 held on the presser body 21 in such a manner that it can be slid in the cloth feeding direction, a button holding device 23 mounted on the upper surface of the presser frame 22 and capable of holding a button, a position detecting device 24 serving as first detecting means for constantly detecting an amount of shift of the presser frame 22 from a sewing start position in the buttonhole stitch, and button diameter detecting switch 25 serving as second detecting means for detecting that sewing operation is carried out up to a length corresponding to the diameter of the button held by the button holding device 23.

<Presser Body>

As shown in FIG. 2, on the upper surface of the presser body 21, there is provided a bar-shaped connecting portion 21*a* which can be held by the forked lower end portion of the presser holder 1*a*. That is, since the presser holder 1*a* is molded of synthetic resin, the forked lower end portion of the holder 1*a* can hold and release the connecting portion 21*a* due to the elastic force thereof to thereby be able to detachably mount the presser body 21 onto the presser bar 1. Also, a needle N, which can be moved vertically by a sewing machine motor 44 (see FIG. 4), penetrates through the eyelet 21N of the presser body 21.

The presser body 21 is connected to a spiral spring 22*a* which is disposed on one end of the presser frame 22 and, unless the presser frame 22 is moved by applying an external force thereto, the presser body 21 is biased in such a manner that it is contacted with a stopper 22*s* provided on one end of the presser frame 22.

<Presser Frame>

As shown in FIG. 2, the presser frame 22 is made of a substantially rectangular-shaped plate member the longitudinal direction of which extends along the cloth feeding direction, while the bottom surface of the presser frame 22 is situated upwardly of a feed dog (not shown) in such a manner that it is opposed to the feed dog. In order that the presser frame 22 can be slid with respect to the presser body 21, in the presser frame 22, there are formed guides 22*b* which respectively extend along the longitudinal direction of the presser frame 22 and into which the presser body 21 can be fitted. In the interior of the stopper 22*s* that is provided on one end of the presser frame 22, there is disposed the spiral spring 22*a* that is used to energize the stopper 22*s* of the presser frame 22 toward the presser body 21. Owing to this spiral spring 22*a*, the stopper 22*s* provided on the presser frame 22, before the sewing is started, is held in contact with the presser body 21.

<Button Holding Device>

As shown in FIG. 2, the button holding device 23 includes a fixed portion 23*b* which is fixed to the other end of the presser frame 22 to hold a portion of a button B, and a sliding portion 23*a* which is opposed to the fixed portion 23*b* and is mounted on the presser frame 22 in such a manner that it can be adjustably moved with respect to the presser frame 22, while the sliding portion 23*a* can cooperate together with the fixed portion 23*b* in holding the button B between them. Although the sliding portion 23*a* can be adjustably moved with respect to the presser frame 22, the sliding portion 23*a* is structured such that, unless an external force is applied thereto, it remains at a given position. In other words, by moving the sliding portion 23*a* according to the size of the button B, the button B can be held stably by and between the sliding portion 23*a* and fixed portion 23*b*.

<Position Detecting Device>

As shown in FIG. 2, the position detecting device 24 includes a variable resistor 24*a* serving as a sliding base and a volume lever 24*b* serving as a sliding member. The variable resistor 24*a* is fixed to the presser frame 22, movable as the presser frame 22 is moved in the cloth feeding direction, and is formed so as to extend along the cloth feeding direction. The volume lever 24*b* is connected to the presser body 21, and slidable within a predetermined position range with respect to the variable resistor 24*a*. In the exemplary embodiment, the variable resistor 24*a* is a slide volume.

The variable resistor 24*a* is disposed on the presser frame 22 in such a manner that it extends substantially parallel to the presser frame 22 along the longitudinal direction thereof, in other words, along the cloth feeding direction. When the variable resistor 24*a* is moved along the cloth feeding direction, the volume lever 24*b* can be slid relatively on the variable resistor 24*a* along the cloth feeding direction; and, the resistance value of the variable resistor 24*a* varies depending on the position of the volume lever 24*b* on the variable resistor 24*a*. The volume lever 24*b* is connected to the presser body 21 by a connecting lever 24*c*. That is, since the presser body 21 is fixed to the presser bar 1, when the presser frame 22 moves along the cloth feeding direction, the volume lever 24*b* moves relatively with respect to the variable resistor 24*a*, the resistance value of the variable resistor 24*a* varies according to the moving amount of the presser frame 22, and thus the voltage value detected varies accordingly. Use of this makes it possible to measure the shift amount of the presser frame 22, in other words, the sewing length, to which the buttonhole stitch has been executed, according to the size of the voltage value detected.

To the variable resistor 24*a*, there is connected a lead wire 24*d*, whereby the value of a voltage applied to the variable resistor 24*a* can be detected by a control device 3 (which will be discussed later). Also, the control device 3 is able to constantly detect the amount of shift of the presser frame 22 with respect to the presser body 21 from the sewing start position, that is, from the state of the presser frame 22 where one end of the presser frame 22 is in contact with the presser body 21.

<Button Diameter Detecting Switch>

As shown in FIG. 2, the button diameter detecting switch 25 includes a detecting portion 25*a* which is disposed on the presser frame 22 and is movable in the cloth feeding direction together with the movement of the presser frame 22 in the cloth feeding direction, and an abutting portion 25*b* which is disposed on the presser body 21 and contacts with the detecting portion 25*a* when the detecting portion 25*a* is moved by a certain distance due to the movement of the presser frame 22.

Figure 3:
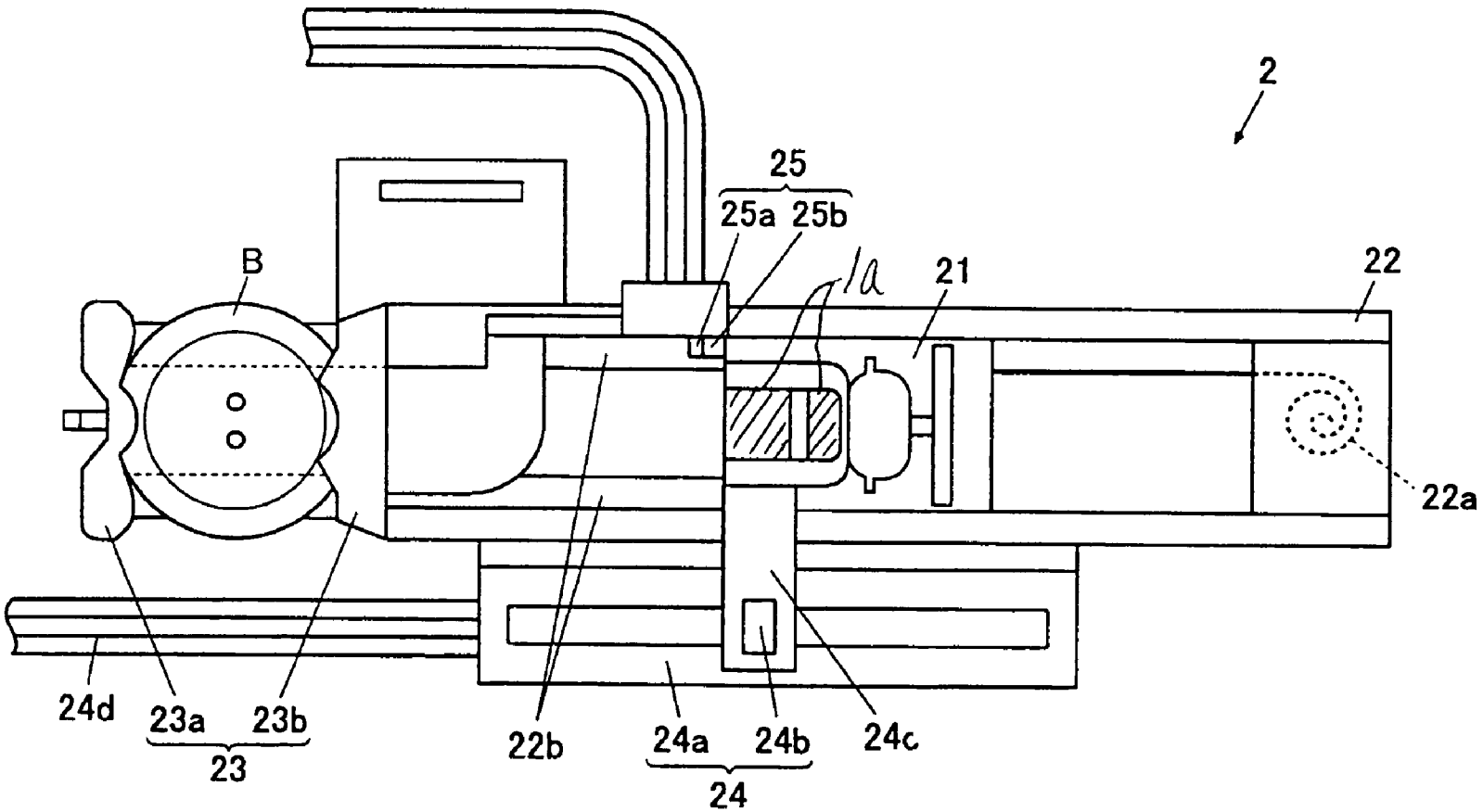
FIG. 3 is a schematic plan view of a buttonhole stitch device.

As shown in FIG. 3, the detecting portion 25*a* is arranged such that, when the presser frame 22 moves, the presser body 21 can project onto a relative move path. After the sewing has been made up to the length corresponding to the diameter of the button B held by the button holding device 23, the detecting portion 25*a* is contacted with the abutting portion 25*b*. According to the detect result, the control device 3 switches the cloth feeding direction and also switches the sewing operation.

To the detecting portion 25*a*, there is connected a lead wire 25*d*; and thus, the value of a voltage applied to the detecting portion 25*a* due to its contact with the abutting portion 25*b* can be detected by the control device 3 (which will be discussed later).

Meanwhile, the lead wire 24*d* connected to the variable resistor 24*a* and the lead wire 25*d* connected to the detecting portion 25*a* are tied up in a bundle and, on the leading end of the bundle, there is mounted a connector 26 which can be detachably mounted on the control device 3.

<Control Device>

The main body of the sewing machine includes the control device 3 which serves as controlling means and controls the driving of a sewing machine motor 44, a needle oscillation step motor 46 and a feed step motor 48 (which will be respectively described later) according to a given sewing program.

Figure 4:
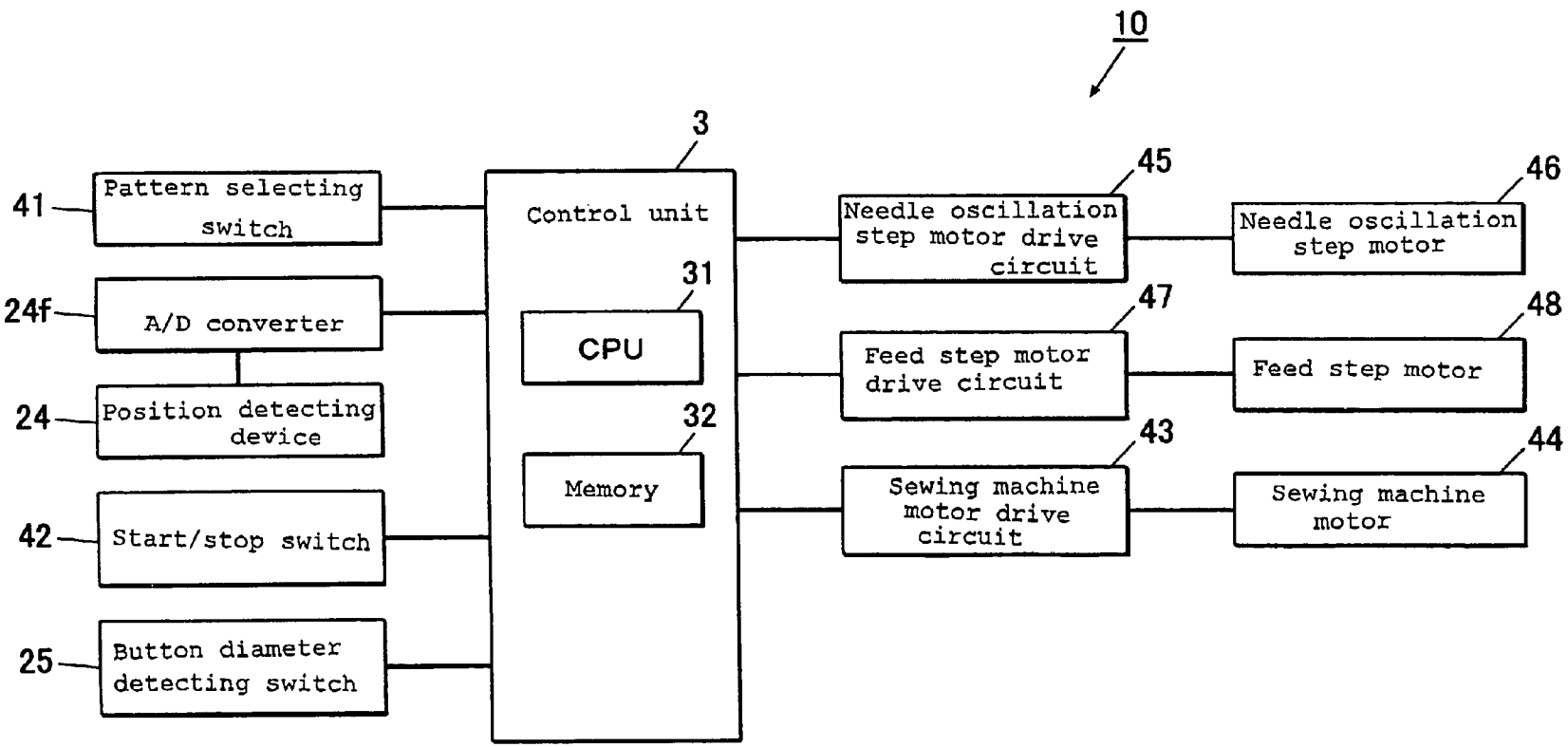
FIG. 4 is a block diagram of the structure of a sewing machine.

As shown in FIG. 4, the control device 3 includes a CPU 31 for carrying out the sewing program, and a memory 32 for storing therein sewing programs, and sewing data and the like on sewing patterns to be sewn (such as an eyelet sewing).

To the control device 3, there are connected a pattern selecting switch 41 for selecting the sewing patterns, and a start/stop switch 42 for inputting the start and stop of the sewing operation. These switches are disposed on the surface of the sewing machine main body, while an input signal to these switches is transmitted to the control device 3.

Also, to the control device 3, there is connected a sewing machine motor drive circuit 43 and, to the sewing machine motor drive circuit 43, there is connected a sewing machine motor 44.

Further, to the control device 3, there is connected a needle oscillation step motor drive circuit 45 and, to the needle oscillation step motor drive circuit 45, there is connected a needle oscillation step motor 46.

To the control device 3, there is connected a feed step motor drive circuit 47 and, to the feed step motor drive circuit 47, there is connected a feed step motor 48.

To the control device 3, there is connected a button diameter detecting switch 25, while the detect output of the button diameter detecting switch 25 is input to the control device 3.

To the control device 3, there is connected a position detecting device 24 through an A/D converter 24*f*, while a detected voltage applied to the variable resistor 24*a* is input to the control device 3 as a detect output.

<Buttonhole Stitch>

Next, description will be given below of a procedure for the buttonhole stitch, by taking an eyelet sewing as an example of sewing patterns.

Figure 5:
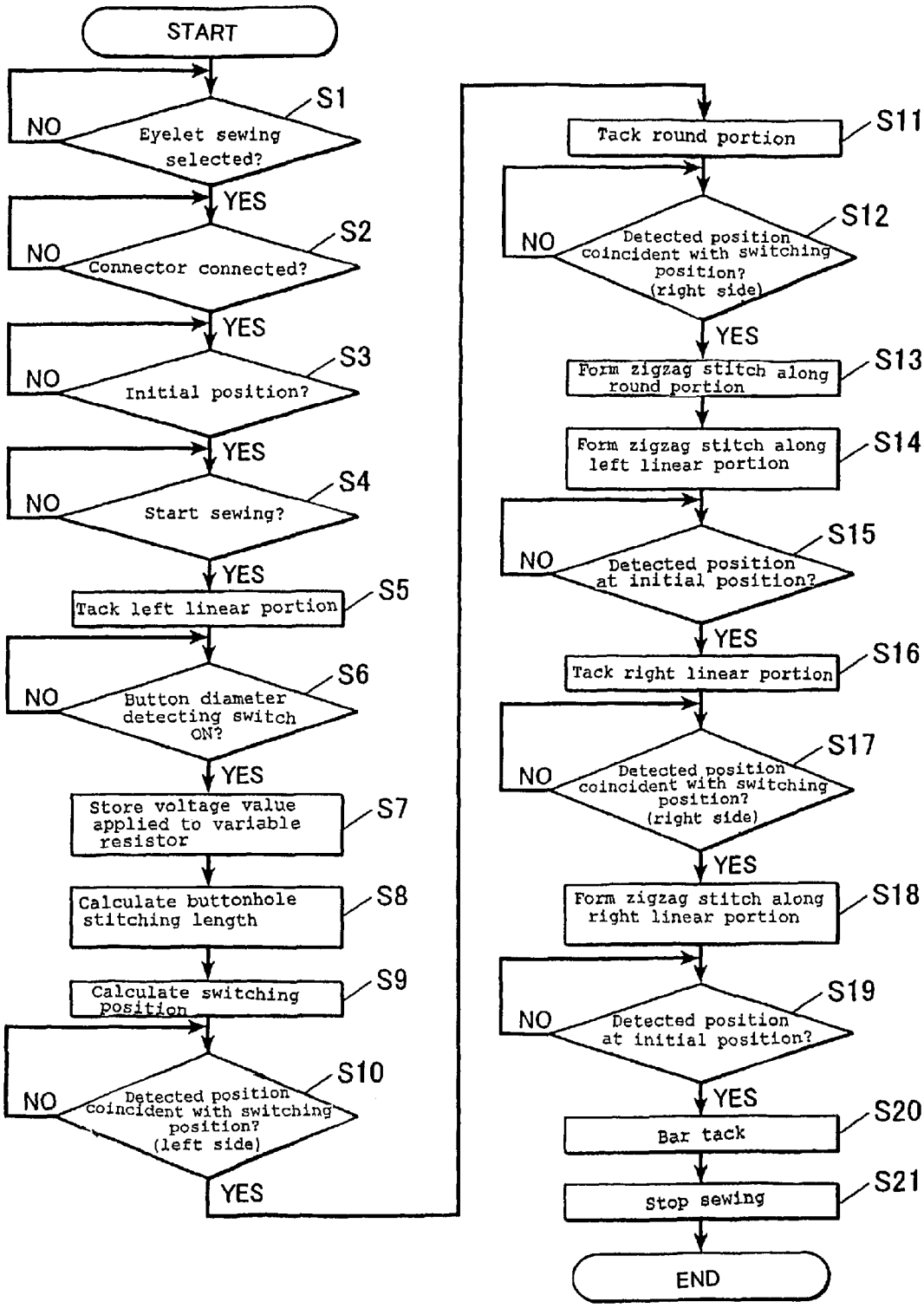
FIG. 5 is a flow chart of an eyelet sewing processing.

As shown in FIG. 5, the control device 3 checks whether an eyelet sewing is selected as the sewing pattern or not (Step S1).

When the control device 3 judges that the eyelet sewing is selected (Step S1: YES), it checks whether the connector 26 is inserted into a given portion of the sewing machine main body or not (Step S2).

When the control device 3 judges that the connector 26 is inserted into the sewing machine main body (Step S2: YES), it checks whether the volume lever 24*b* is present at the initial position (the position shown in FIG. 2) of the variable resistor 24*a* or not, that is, whether the stopper 22*s* of the presser frame 22 is contacted with the presser body 21 or not (Step S3).

When the control device 3 judges that the volume lever 24*b* is present at the initial position of the variable resistor 24*a* and thus the stopper 22*s* of the presser frame 22 is contacted with the presser body 21 (Step S3: YES), it checks whether the start/stop switch 42 is depressed or not (Step S4).

Figure 6A:
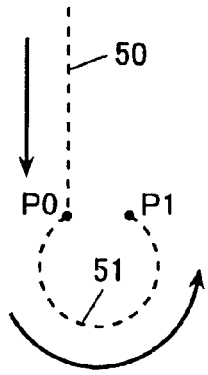
FIG. 6 is a view of a procedure for an eyelet sewing.

When the control device 3 judges that the start/stop switch 42 is depressed (Step S4: YES), as shown in FIG. 6A, it drives the feed step motor 48 reversely, whereby a tack 50 in the left straight line portion of the eyelet sewing is executed in a reverse teed manner (Step S5). During this tacking operation, the control device 3 constantly checks whether the detecting portion 25*a* and the abutting portion 25*b* are contacted with each other or not (Step S6). When the presser frame 22 moves and the control device 3 judges that the abutting portion 25*b* provided on the presser body 21 is contacted with the detecting portion 25*a* (Step S6: YES), the control device 3 reads the value of a voltage applied to the variable resistor 24*a* and stores it into the memory 32 (Step S7).

Figure 7:
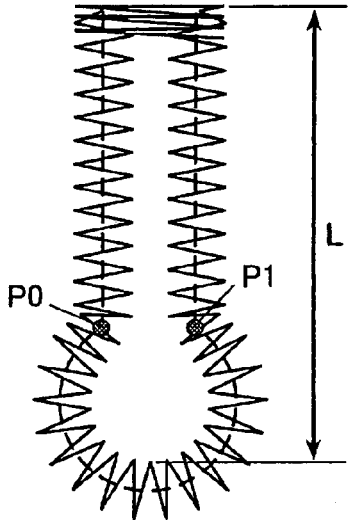
FIG. 7 is a view of an eyelet sewing pattern.

The control device 3 calculates an actual buttonhole stitching length L (see FIG. 7) from the voltage value stored in the memory 32 in Step S7 (Step S8), and further, the control device 3 calculates a switching position P0, which is a switch point between the linear stitch and chain stitch of the eyelet sewing, and stores it into the memory 32 (Step S9).

Next, since the buttonhole stitching length L is calculated from the voltage value applied to the variable resistor 24*a* (which is constantly read by the control device 3), the control device checks whether a position distant by the buttonhole stitching length from the initial position is coincident with the switching position P0 or not (Step S10).

When the control device 3 judges that the point is coincident with the switching position P0 (Step S10: YES), the control device 3 carries out the tack 51 of the round portion as shown in FIG. 6A in accordance with sewing data on the round portion stored in the memory 32 (Step S11).

Next, the control device 3 checks whether a position corresponding to the distance from the initial position calculated from the value of the voltage applied to the variable resistor 24*a* is the right switching position P1 or not, that is, whether the position is coincident with the left switching position P0 or not (Step S12).

Figure 6B:
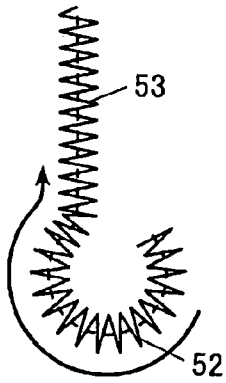

When the control device 3 judges that the tack 51 of the chain stitch has arrived at the switching position P1 (Step S12: YES), as shown in FIG. 6B, the control device 3 switches the cloth feeding direction over to the forward feeding direction, and carries out the zigzag stitch 52 of the round portion with previously set needle oscillation width and pitch (Step S13), and also carries out the zigzag stitch 53 of the left linear portion continuously with the zigzag stitch 52 (Step S14).

Figure 6C:
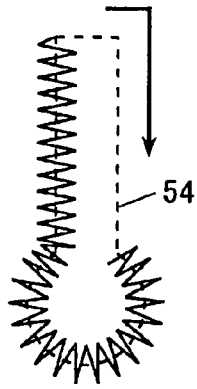

During the process of the zigzag stitch 53 of the left linear portion, the control device 3 checks whether the distance from the initial position calculated from the value of the voltage applied to the variable resistor 24*a* has become 0 or not, that is, whether the presser frame 22 has returned to the initial position or not (Step S15). When the control device 3 judges that the distance from the initial position calculated from the value of the voltage applied to the variable resistor 24*a* has become 0 (Step S15: YES), as shown in FIG. 6C, the control device 3 switches the cloth feeding direction over to the reverse feeding direction and carries out the tack 54 of the right linear portion (Step S16).

During the process of the tack 54 of the right linear portion, the control device 3 checks whether the position distant from the initial position by the distance calculated from the value of the voltage applied to the variable resistor 24*a* is coincident with the switching positions P0, P1 or not (Step S17).

Figure 6D:
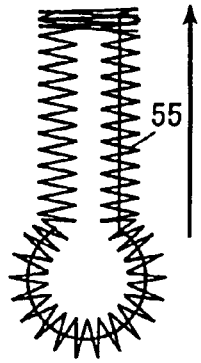

In Step S17, when the control device 3 judges that the position distant from the initial position by the distance calculated from the value of the voltage applied to the variable resistor 24*a* is coincident with the switching positions P0, P1 (Step S17: YES), as shown in FIG. 6D, the control device 3 switches the cloth feeding direction over to the forward direction and executes the zigzag stitch 55 of the right linear portion (Step S18).

In the process of the zigzag stitch of the right linear portion, the control device 3 checks whether the distance from the initial position calculated from the value of the voltage applied to the variable resistor 24*a* has become 0 or not, that is, whether the presser frame 22 has returned to the initial position or not (Step S19). When the control device 3 judges that the distance from the initial position calculated from the value of the voltage applied to the variable resistor 24*a* has become 0 (Step S19: YES), the control device 3 carries out a bar tack (Step S20) and, when the bar tack is formed, the control device 3 ends the present processing (Step 521).

According to the sewing machine 10 of the exemplary embodiment, in a state where the button B is held by the button holding device 23 and a workpiece is pressed by the presser frame 22 slidably held by the presser body 21, when the workpiece is sewn while feeding the workpiece, the presser frame 22 is also moved in the feeding direction of the workpiece in linking with the sewing operation. With the movement of the presser frame 22, the variable resistor 24*a* provided on the presser frame 22 is also moved along the feeding direction of the workpiece, while the volume lever 24*b* is moved on the variable resistor 24*a* with respect to the variable resistor 24*a*. Owing to this, the position detecting device 24 is able to measure the moving distance of the presser body 21 from the sewing start position according to the contact position between the variable resistor 24 and volume lever 24*b*.

Also, since the presser frame 22 moves along the feeding direction of the workpiece, the detecting portion 25*a* formed in the sliding portion 23*a* is contacted with the abutting portion 25*b* formed in the presser body 21. This allows the button diameter detecting switch 25 to detect that the sewing operation has been carried out up to the length corresponding to the diameter of the button.

When the control device 3 detects that the sewing operation has been carried out up to the length corresponding to the diameter of the button, the control device 3 obtains the shift amount of the presser body 21 from the position detecting device 24, and also controls the driving of the sewing needle and the feeding of the workpiece in such a manner that the buttonhole stitch corresponding to the diameter of the button can be executed.

As described above, since the detecting portion 25*a* of the button diameter detecting switch 25 is not disposed on the presser body 21 but on the presser frame 22 which is larger than the presser body 21, it is possible to reduce a detection error in the sewing length detection due to the rickety motion of the detecting portion 25*a* or the like.

Also, since the abutting portion 25*b* of the button diameter detecting switch 25 is disposed on the presser body 21 and the detecting portion 25*a* is disposed on the sliding portion 23*a*, there is eliminated the need for the variable resistor 24*a* of the position detecting device 24 to detect that the sewing operation has been carried out up to the length corresponding to the diameter of the button as in the conventional sewing machine. This makes it possible to reduce the detection error as much as possible that occurs in the conventional sewing machine when detecting the timing for switching the sewing operation due to provision of an arm portion or the like, thereby being able to enhance the quality of the buttonhole stitch.

Further, because the button holding device 23 and position detecting device 24 are not directly connected to each other, there is eliminated the possibility of the occurrence of the poor torque and poor position accuracy that is caused by the direct connection between the position detecting device 24 and button holding device 23.

Figure 8:
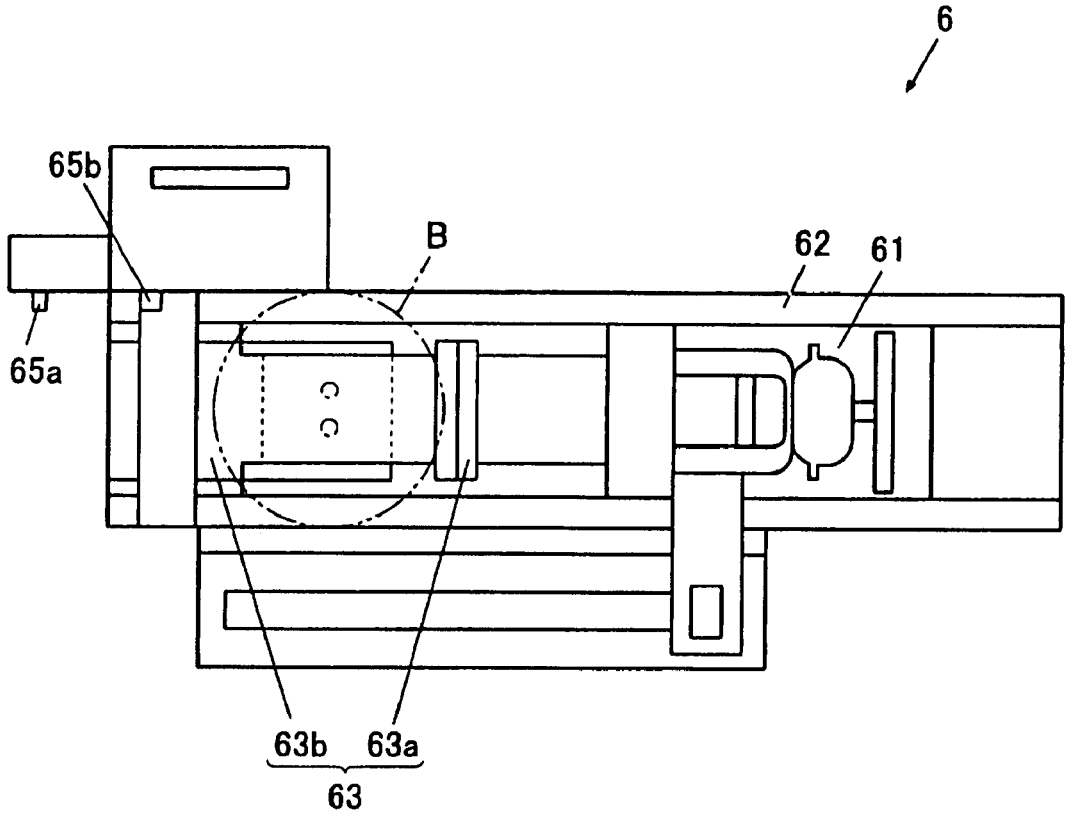
FIG. 8 is a schematic plan view of another exemplary embodiment of a buttonhole stitch device.
Figure 9:
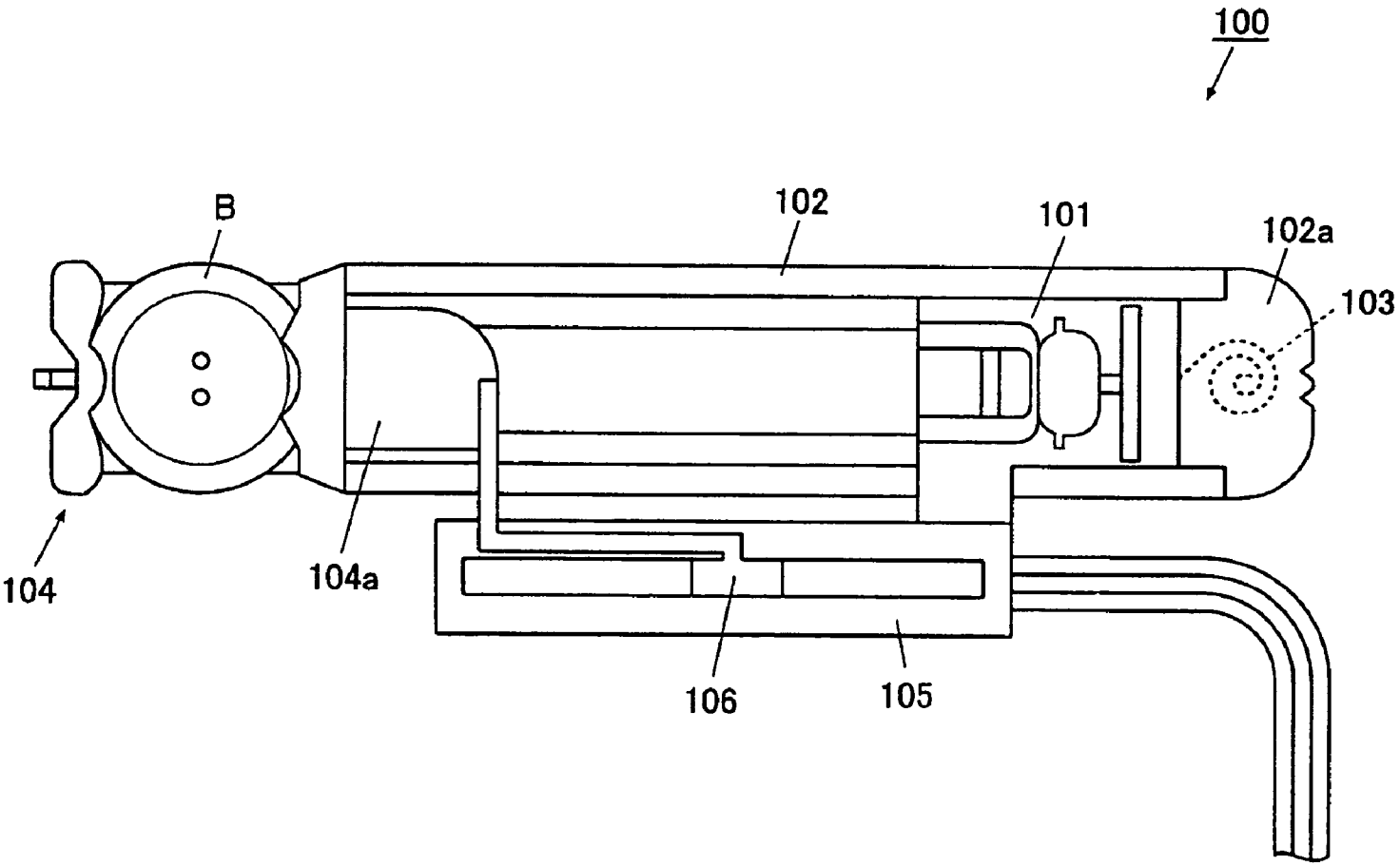
Fig.9 Prior art
FIG. 9 is a schematic plan view of a conventional buttonhole stitch device.
Figure 10:
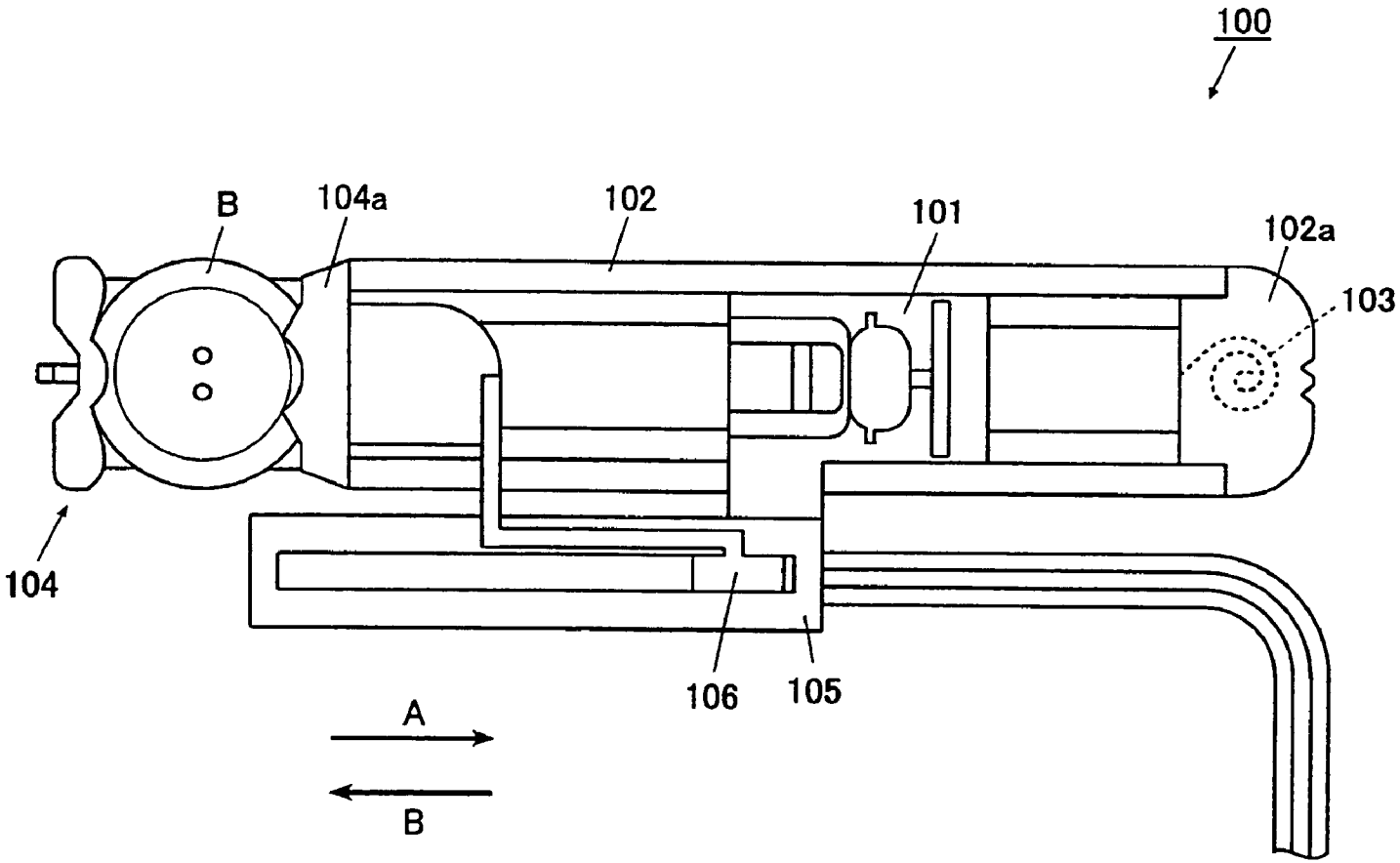
Fig.10 Prior art
FIG. 10 is a schematic plan view of a conventional buttonhole stitch device.
Figure 11:
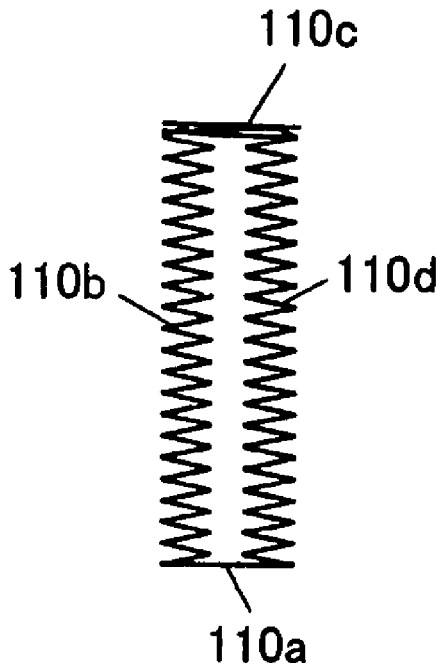
FIG. 11 is a view of a buttonhole stitch pattern.

The scope of the invention is not limited to the above-mentioned exemplary embodiment. For example, the invention can also apply to a sewing machine which includes such a buttonhole stitch device 6 as shown in FIG. 8. More specifically, in the buttonhole stitch device 6, a presser frame 62 is disposed so as to be slidable with respect to a presser body 61, and a button holding device 63 is fixed to the presser body 61. The sliding portion 63*b* of the button holding device 63 is disposed on the opposite side of the presser body 61 with the fixed portion 63*a* of the button holding device 63 being interposed therebetween in such a manner that it can be adjustably moved with respect to the presser frame 62. The abutting portion 65*b* of a button diameter detecting switch 65 is disposed on the sliding portion 63*b*, while the detecting portion 65*a* of the button diameter detecting switch 65 is disposed outside the presser frame 62 and on the moving path of the sliding portion 63*b*.

According to this structure, when the buttonhole stitch is started and the presser frame 62 is moved along the cloth feeding direction, the detecting portion 65*a* disposed on the presser frame 62 is contacted with the abutting portion 65*b* disposed on the sliding portion 63. This makes it possible to detect that the sewing operation has been carried out up to the length corresponding to the diameter of the button held by the button holding device 63. Therefore, in this structure as well, there can be provided similar effects to those in the above-mentioned exemplary embodiment.

Also, although the slide volume is employed as the position detecting device 24, a rotation type volume, a photo sensor, or a magnetic sensor may be employed as the position detecting device 24.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

[FIG. 4]

| | |
|---|---|
| 41 | Pattern selecting switch |
| 24f | A/D converter |
| 24 | Position detecting device |
| 42 | Start/stop switch |
| 25 | Button diameter detecting switch |
| 3 | Control unit |
| 32 | Memory |
| 45 | Needle oscillation step motor drive circuit |
| 47 | Feed step motor drive circuit |
| 43 | Sewing machine motor drive circuit |
| 46 | Needle oscillation step motor |
| 48 | Feed step motor |
| 44 | Sewing machine motor |

[FIG. 5]

| | |
|---|---|
| S1 | Eyelet sewing selected? |
| S2 | Connector connected? |
| S3 | Initial position? |
| S4 | Start sewing? |
| 55 | Tack left linear portion |
| $6 | Button diameter detecting switch ON? |
| S7 | Store voltage value applied to variable resistor |
| S8 | Calculate buttonhole stitching length |
| S9 | Calculate switching position |
| S10 | Detected position coincident with switching position? (left side) |
| S11 | Tack round portion |
| S12 | Detected position coincident with switching position? (right side) |
| S13 | Form zigzag stitch along round portion |
| $14 | Form zigzag stitch along left linear portion |
| S15 | Detected position at initial position? |
| S16 | Tack right linear portion. |
| S17 | Detected position coincident with switching position? (right side) |
| S18 | Form zigzag stitch along right linear portion. |
| S19 | Detected position at initial position? |
| S20 | Bar tack |
| S21 | Stop sewing |

What is claimed is:

1. A sewing machine comprising:

a presser body supported on a lower end of a presser bar;

a presser frame which is slidable with respect to the presser body, and is operable to press a workpiece and to move in accordance with a feeding of the workpiece during a sewing operation;

a button holding device including a fixed portion, and a sliding portion facing the fixed portion and movable along a cloth feeding direction with respect to the presser frame, and wherein the button holding device is operable to hold a button between the fixed portion and the sliding portion;

a position detecting device including a sliding base attached to the presser frame so as to extend along the cloth feeding direction, and a sliding member attached to the presser body and slidable with respect to the sliding base, wherein the position detecting device is operable to detect a shift amount of the presser frame from a sewing start position in accordance with a contact position of the sliding member and the sliding base in the cloth feeding direction;

a button diameter detecting switch including a detecting portion attached to the presser frame and movable in the cloth feeding direction together with the presser frame, and an abutting portion which contacts with the detecting portion when the detecting portion is moved by a certain distance in accordance with a movement of the presser frame, wherein the button diameter detecting switch is operable to detect that the sewing operation is carried out by a length that corresponds to a diameter of the button held by the button holding device; and a control device which is operable to obtain, from the position detecting device, the shift amount of the presser body from the sewing start position when the button diameter detecting switch detects that the sewing operation is carried by the length that corresponds to the diameter of the button, and is operable to control a drive of a sewing needle and the feeding of the workpiece such that a buttonhole stitch corresponding to the diameter of the button is formed.

2. The sewing machine according to claim 1, wherein the fixed portion is fixed to the presser frame, and the abutting portion is attached to the presser body.

3. The sewing machine according to claim 1, wherein the fixed portion is fixed to the presser body, and the abutting portion is attached to the sliding portion.

4. The sewing machine according to claim 1, wherein the sliding body is disposed on one longitudinal side of the presser frame, and the detecting portion is disposed on the other longitudinal side of the presser frame.

* * * * *